US009046291B2

(12) United States Patent
Meltzer et al.

(10) Patent No.: US 9,046,291 B2
(45) Date of Patent: Jun. 2, 2015

(54) USER-SELECTABLE OPERATING MODES FOR REFRIGERATION APPLIANCES

(75) Inventors: Aaron Meltzer, Anderson, SC (US); Kurt Froehlich, Easley, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 179 days.

(21) Appl. No.: 13/487,615

(22) Filed: Jun. 4, 2012

(65) Prior Publication Data

US 2013/0319017 A1 Dec. 5, 2013

(51) Int. Cl.

| | |
|---|---|
| ***F25D 29/00*** | (2006.01) |
| *F25D 17/06* | (2006.01) |
| *F25D 21/00* | (2006.01) |
| *F25D 27/00* | (2006.01) |

(52) U.S. Cl.

CPC ..... *F25D 29/00* (2013.01); *F25D 17/065* (2013.01); *F25D 21/002* (2013.01); *F25D 27/005* (2013.01); *F25D 2400/361* (2013.01); *F25D 2700/02* (2013.01)

(58) Field of Classification Search

CPC ..... F25D 17/065; F25D 21/002; F25D 21/08; F25D 27/005; F25D 2600/02; F24F 13/24; F25B 49/022; F25B 2500/12; F25B 2600/02; F25B 2600/112

USPC ..... 62/56, 126, 154, 155, 157, 178, 180, 62/187, 228.1, 296

See application file for complete search history.

(56) References Cited

U.S. PATENT DOCUMENTS

| | | | | |
|---|---|---|---|---|
| 5,315,835 | A * | 5/1994 | Park | 62/80 |
| 5,428,965 | A * | 7/1995 | Grunwald et al. | 62/180 |
| 5,818,428 | A | 10/1998 | Eisenbrandt et al. | |
| 5,907,955 | A * | 6/1999 | Park | 62/131 |
| 6,786,421 | B2 | 9/2004 | Rosen | |

(Continued)

FOREIGN PATENT DOCUMENTS

| | | |
|---|---|---|
| CA | 2419647 | 8/2004 |
| DE | 102007032053 | 1/2009 |

(Continued)

OTHER PUBLICATIONS

International Search Report for PCT/US2013/043648, dated Oct. 11, 2013, 3 pages.

*Primary Examiner* — Mohammad M Ali

*Assistant Examiner* — Christopher R Zerphey

(74) *Attorney, Agent, or Firm* — Pearne & Gordon LLP

(57) ABSTRACT

A refrigeration appliance, such as a household refrigerator that can include freezer and fresh food compartments, includes operating components that can be controlled so as to allow a user to select for implementation at the refrigeration appliance modes of operation that can optimize the performance of the refrigeration appliance with respect to selected operating objectives. The refrigeration appliance also can include a respective actuating device corresponding to each mode of operation that is available for selective implementation by the user upon the activation of the respective actuating device and a controller configured to direct operating commands to the one or more operating components in response to the activation of a respective actuating device, causing the one or more operating components to operate in a manner so as to selectively implement at the refrigeration appliance the mode of operation corresponding to the respective actuating device activated.

14 Claims, 2 Drawing Sheets

(56) References Cited

U.S. PATENT DOCUMENTS

| | | | | |
|---|---|---|---|---|
| 6,975,958 | B2 | 12/2005 | Bohrer et al. | |
| 7,423,546 | B1 | 9/2008 | Aisa | |
| 7,591,141 | B2 | 9/2009 | Wetekamp et al. | |
| 7,604,046 | B2 | 10/2009 | Bergman | |
| 7,607,312 | B2 | 10/2009 | Wetekamp et al. | |
| 2003/0056526 | A1* | 3/2003 | Holmes et al. | 62/156 |
| 2003/0182951 | A1* | 10/2003 | Rafalovich et al. | 62/154 |
| 2004/0216472 | A1 | 11/2004 | Cho | |
| 2007/0157645 | A1* | 7/2007 | Anell et al. | 62/187 |
| 2007/0255457 | A1 | 11/2007 | Whitcomb et al. | |
| 2010/0030383 | A1 | 2/2010 | Wetekamp et al. | |
| 2010/0042453 | A1 | 2/2010 | Scaramellino et al. | |
| 2010/0101254 | A1* | 4/2010 | Besore et al. | 62/264 |
| 2010/0114378 | A1* | 5/2010 | Son et al. | 700/275 |
| 2011/0000237 | A1* | 1/2011 | Wetekamp et al. | 62/151 |
| 2011/0088415 | A1* | 4/2011 | Lacey et al. | 62/80 |
| 2011/0304466 | A1 | 12/2011 | Bair et al. | |

FOREIGN PATENT DOCUMENTS

| | | |
|---|---|---|
| KR | 20080050832 | 6/2008 |
| WO | 2008064179 | 5/2008 |

* cited by examiner

USER-SELECTABLE OPERATING MODES FOR REFRIGERATION APPLIANCES

BACKGROUND OF THE INVENTION

Field of the Invention

The present invention relates generally to apparatus and method for efficiently operating a refrigeration appliance and, in particular, to apparatus and method that allow a user to operate a refrigeration appliance in a selected one of a plurality of operational modes.

Discussion of the Prior Art

The conditions under which a refrigeration appliance, such as a household refrigerator for example, operates can be varied. In certain circumstances, the operating conditions can be controlled through the manipulation by a user of control mechanisms provided at the refrigeration appliances. For example, a refrigeration appliance can include a cooling system that includes a compressor, a condenser, a metering device such as capillary tube and an evaporator; and the temperatures established within the refrigeration appliance, such as in the case in which the refrigeration appliance includes a freezer compartment and a fresh food compartment for example, can be influenced by the quantity of cooling air directed by the cooling system to these two compartments and the timing of the delivery of the cooling air. In turn, the quantity of cooling air generated and directed by the cooling system in the first instance to the freezer compartment and subsequently to the fresh food compartment and the timing of the delivery of the cooling air can be controlled by controlling the operation of the cooling system so that the compressor only operates when there is insufficient cold air present to support the temperature levels required in the freezer compartment and fresh food compartment. The operation of the compressor can be controlled by the manipulation by the user of a thermostat provided at the refrigeration appliance in a manner familiar to those skilled in the art.

In certain other circumstances, the operating conditions of the refrigeration appliance can be controlled by control mechanisms with respect to which the user has no influence and which function in accordance with features that are preset and fixed in the architecture of the refrigeration appliance. For example, the refrigeration appliance can include an automatic defrosting system that is programmed to operate, for example, on a specified timeline or in response to some other consideration such as the frequency of the cycling of the cooling system for example.

Typically, it is the case that users do not have a good understanding of the interrelationships of all the variables that affect the operation of a refrigeration appliance, and/or are not provided with adequate control mechanisms, in order to optimally place the refrigeration appliance in a mode of operation desired by the user.

BRIEF DESCRIPTION OF THE INVENTION

The following sets forth a simplified summary of examples of the present invention for the purpose of providing a basic understanding of selected aspects of the invention. The summary does not constitute an extensive overview of all the aspects or embodiments of the invention. Neither is the summary intended to identify critical aspects or delineate the scope of the invention. The sole purpose of the summary is to present selected aspects of the invention in a simplified form as an introduction to the more detailed description of the embodiments of the invention that follows the summary.

In accordance with one aspect of the invention a refrigeration appliance, such as a household refrigerator that includes a freezer compartment and a fresh food compartment for example, includes operating components that are controlled so as to allow a user to select for implementation at the refrigeration appliance one or more modes of operation that can enhance the performance of the refrigeration appliance with respect to one or more operating objectives.

According to another aspect of the invention, a refrigeration appliance includes one or more operating components that are configured to operate in accordance with operating commands that are directed to the one or more operating components and implement at the refrigeration appliance a mode of operation that is available for selective implementation by a user. The refrigeration appliance also includes a respective actuating device corresponding to each mode of operation of the refrigeration appliance that is available for selective implementation by the user upon the activation by the user of the respective actuating device. A controller is operably associated with the one or more operating components and each respective actuating device. The controller is configured to direct operating commands to the one or more operating components in response to the activation by the user of a respective actuating device, causing the one or more operating components to which operating commands are directed to operate in a manner so as to selectively implement at the refrigeration appliance the mode of operation corresponding to the respective actuating device selectively activated by the user. According to a further aspect of the invention, two or more of the operating components can be configured to operate in accordance with operating commands directed to the two or more operating components from the controller and two or more actuating devices can be provided with each actuating device corresponding to a respective mode of operation that is available for selective implementation by the user at the refrigeration appliance.

According to a further aspect of the invention, although there is no fixed limit on the number of modes of operation that can be made available, in a particular embodiment of the invention, the refrigeration appliance can include at least one actuating device corresponding to a respective one of the following three modes of operation that can be available for selective implementation by the user at the refrigeration appliance: a mode of operation that maintains the consumption of energy at the refrigeration appliance at reduced levels; a mode of operation that controls the variations in the temperatures in the refrigeration appliance to which items stored in the refrigeration appliance are subject so as to provide for a stable temperature profile; and a mode of operation that maintains the noise generated at the refrigeration appliance at reduced levels. In a particular embodiment, each of at least two or more actuating devices can correspond to a respective one of these three modes of operation.

According to an additional aspect of the invention, one of the two or more respective actuating devices can correspond to a mode of operation that maintains the consumption of energy at the refrigeration appliance at reduced levels. And, the two or more operating components to which operating commands are directed by the controller to implement the mode of operation that maintains the consumption of energy at the refrigeration appliance at reduced levels can include two or more of a plurality of operating components comprising for example: apparatus configured to defrost the refrigeration appliance on demand; a damper system located in an air passageway leading from a freezer compartment to a temperature-controlled drawer located in a fresh food compartment of a bottom-mount refrigerator; apparatus configured to modify the level of illumination provided by lighting elements located at the refrigeration appliance; a compressor that is part of the system for producing cold air at the refrigeration appliance; and an apparatus for making ice. The operating components to which operating commands are directed by the controller to implement a mode of operation concerning the consumption of energy are not limited to the foregoing five operating components however.

According to yet another aspect of the invention, one of the two or more respective actuating devices can correspond to a mode of operation that controls the variations in the temperatures present in the refrigeration appliance to which items stored in the refrigeration appliance are subject so as to provide for a stable temperature profile. And, the two or more operating components to which operating commands are directed by the controller to implement the mode of operation that controls the variations in the temperatures present in the refrigeration appliance to which items stored in the refrigeration appliance are subject so as to provide for a stable temperature profile can include two or more of a plurality of operating components comprising for example: a damper located in a passageway of the refrigeration appliance for controlling the circulation of cold air in the passageway from a freezer compartment of the refrigeration appliance to a fresh food compartment of the refrigeration appliance; an evaporator fan that is a part of a system for producing cold air at the refrigeration appliance; and a compressor that is part of the system for producing cold air at the refrigeration appliance. However, the operating components to which operating commands are directed by the controller to implement a mode of operation concerning the control of temperatures in the refrigeration appliance are not limited to the foregoing three operating components.

According to yet a further aspect of the invention, one of the two or more respective actuating devices can correspond to a mode of operation that maintains the noise generated at the refrigeration appliance at reduced levels. And, the two or more operating components to which operating commands are directed by the controller to implement the mode of operation that maintains the noise generated at the refrigeration appliance at reduced levels can include two or more of a plurality of operating components comprising for example: one or more fans; a compressor that is part of the system for producing cold air at the refrigeration appliance; apparatus for making ice at the refrigeration appliance; and apparatus configured to defrost the refrigeration appliance on demand including a heater whose heating action can be pulsed. However, the operating components to which operating commands are directed by the controller to implement a mode of operation concerning the reduction of noise at the refrigeration appliance are not limited to the foregoing four operating components.

According to yet an additional aspect of the invention, one of the two or more respective actuating devices can correspond to a mode of operation that maintains the consumption of energy at the refrigeration appliance at reduced levels and the other of the two or more respective actuating devices can correspond to a mode of operation that controls the variations in the temperatures present in the refrigeration appliance to which items stored in the refrigeration appliance are subject so as to provide for a stable temperature profile. In a particular embodiment of this aspect, the two or more operating components to which operating commands are directed to implement a respective one of these two modes of operation can include two or more of a plurality of operating components comprising for example: apparatus configured to defrost the refrigeration appliance on demand; a damper system located in an air passageway leading from a freezer compartment to a temperature-controlled drawer located in a fresh food compartment of a bottom-mount refrigerator; apparatus configured to modify the level of illumination provided by lighting elements located at the refrigeration appliance; a compressor that is part of the system for producing cold air at the refrigeration appliance; an apparatus for making ice; a damper located in a passageway of the refrigeration appliance for controlling the circulation of cold air in the passageway from a freezer compartment of the refrigeration appliance to a fresh food compartment of the refrigeration appliance; and an evaporator fan that is a part of a system for producing cold air at the refrigeration appliance. However, the operating components to which operating commands are directed by the controller to implement a mode of operation concerning energy consumption and a mode of operation concerning the control of temperatures at the refrigeration appliance are not limited to the foregoing seven operating components.

According to still another aspect of the invention, in addition to one of the two or more respective actuating devices corresponding to a mode of operation that maintains the consumption of energy at the refrigeration appliance at reduced levels and another of the two or more respective actuating devices corresponding to a mode of operation that controls the variations in the temperatures present in the refrigeration appliance to which items stored in the refrigeration appliance are subject so as to provide for a stable temperature profile, a third respective actuating device can correspond to a mode of operation that maintains the noise generated at the refrigeration appliance at reduced levels. In a particular embodiment of this aspect, the two or more operating components to which operating commands are directed to implement a respective one of these three modes of operation can include two or more of a plurality of operating components comprising for example: apparatus configured to defrost the refrigeration appliance on demand; apparatus configured to defrost the refrigerator appliance on demand including a heater whose heating action can be pulsed; a damper system located in an air passageway leading from a freezer compartment to a temperature-controlled drawer located in a fresh food compartment of a bottom-mount refrigerator; apparatus configured to modify the level of illumination provided by lighting elements located at the refrigeration appliance; a compressor that is part of the system for producing cold air at the refrigeration appliance; an apparatus for making ice; a damper located in a passageway of the refrigeration appliance for controlling the circulation of cold air in the passageway from a freezer compartment of the refrigeration appliance to a fresh food compartment of the refrigeration appliance; and one or more fans including an evaporator fan. However, the operating components to which operating commands are directed by the controller to implement a mode of operation concerning energy consumption, a mode of operation concerning the control of temperatures at the refrigeration appliance and a mode of operation concerning the control of noise levels are not limited to the foregoing eight operating components.

According to still a further aspect of the invention, with respect to the aspects of the invention set forth above, at least one of the one or more operating components can be initially preset to operate in a prescribed manner. In that case, the controller can be configured, in response to the activation by the user of a respective actuating device, to direct operating commands to the at least one of the one or more operating components initially preset and modify the presetting of the at least one of the one or more operating components that is initially preset. In an embodiment wherein two or more operating components are initially preset to operate in a prescribed manner, the controller can be configured, in response to the activation by the user of a respective actuating device, to direct operating commands to the two or more operating components that are initially preset and modify the presetting of the two or more operating components that are initially preset.

According to still an additional aspect of the invention, with respect to the aspects of the invention set forth above, the controller can be configured, upon the activation by the user of a respective actuating device, to direct operating commands to at least one of the of the one or more operating components taking into account a statistical analysis of the frequency and times of day at which the interior of the refrigeration appliance is exposed to the ambient environment. In the embodiment in which a respective actuating device corresponds to a mode of operation that maintains the noise generated at the refrigeration appliance at reduced levels, the controller can be configured, upon the activation by a user of that respective actuating device, to direct operating commands to two or more operating components taking into account a determination of the times of day during which it is preferred that noise generated at the refrigeration appliance be maintained at reduced levels.

Other aspects of the invention concern methods of operating a refrigeration appliance that can include one or more operating components that are configured to operate in accordance with operating commands directed to the one or more operating components and implement at the refrigeration appliance a mode of operation that is available for selective implementation by a user. The refrigeration appliance also can include a respective actuating device corresponding to each mode of operation that is available for selective implementation by the user at the refrigeration appliance upon the activation by the user of the respective actuating device. The methods can include activating a respective actuating device that corresponds to a mode of operation selected for implementation and directing operating commands to the one or more operating components in response to the activation of the respective actuating device, causing the one or more operating components to which operating commands are directed to operate in a manner so as to selectively implement at the refrigeration appliance the mode of operation selected for implementation. In connection with these other aspects of the invention concerning methods of operating a refrigeration appliance, the methods can be applied in connection with the various aspects of the invention described in the preceding paragraphs.

BRIEF DESCRIPTION OF THE DRAWINGS

The foregoing and other aspects of the present invention will be apparent to those skilled in the art to which the present invention relates from the detailed descriptions of examples of aspects and embodiments of the invention that follow with reference to the accompanying drawings, wherein the same reference numerals are used in the several figures to refer to the same parts or elements and in which.

DETAILED DESCRIPTION

Examples of embodiments that incorporate one or more aspects of the present invention are described below with references, in certain respects, to the accompanying drawings. These examples are not intended to be limitations on the present invention. Thus, for example, in some instances, one or more examples of the present invention described with reference to one aspect or embodiment can be utilized in other aspects and embodiments. In addition, certain terminology is used herein for convenience only and is not to be taken as limiting the present invention.

Figure 1:
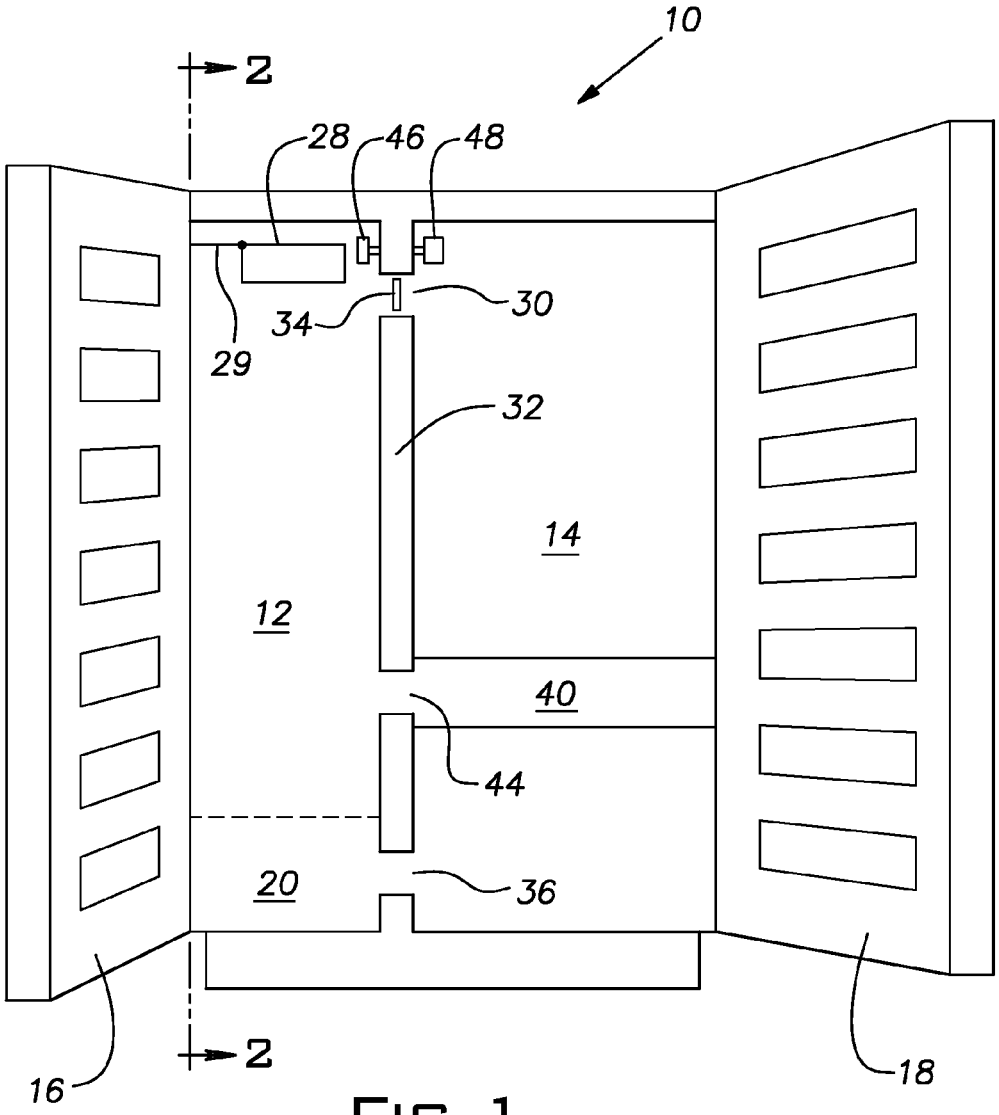
FIG. 1 is a schematic illustration of a front elevational view of the invention as applied to a refrigeration appliance that includes a freezer compartment arranged alongside a fresh food compartment.

An embodiment of the invention is illustrated in FIG. 1 of the drawings wherein a refrigeration appliance, indicated generally at 10, that comprises a so-called side-by-side household refrigerator that includes a freezer compartment 12 arranged alongside a fresh food compartment 14 is shown. Access to the interior of the freezer compartment can be had through freezer compartment door 16, which is pivotally mounted at one side of the refrigerator and is shown to be open in FIG. 1. Access to the interior of the fresh food compartment can be had through fresh food compartment door 18, which is pivotally mounted at the other side of the refrigerator and is also shown to be open in FIG. 1. Although aspects of the invention are described below with reference to the side-by-side refrigerator of FIG. 1, the invention also is applicable in certain of its aspects to other kinds of refrigeration appliances such as, for example, household refrigerators in which the freezer compartment is located above the fresh food compartment and household refrigerators in which the freezer compartment is located beneath the fresh food compartment, the latter sometimes being referred to as bottom-mount refrigerators.

Refrigeration appliances that are currently available include a plurality of operating components that in one respect or another can influence the manner in which the refrigeration appliance operates or functions. Thus, the refrigeration appliances include, for example, evaporators, fans, compressors, dampers and other operating components that can control the operating characteristics of the refrigeration appliances as is well known to those having ordinary skill in the art. In some instances, the operation of one or more operating components can be manipulated by the user even though their operation may be initially preset. In other instances, the operation of certain of the operating components is fixedly preset at the time the refrigeration appliance is manufactured and the user is not provided with means for manipulating their operation. And in even other instances, the operations of certain operating components are subject to manipulation by the user while the operations of certain other operating components are fixed and cannot be manipulated by the user.

Figure 2:
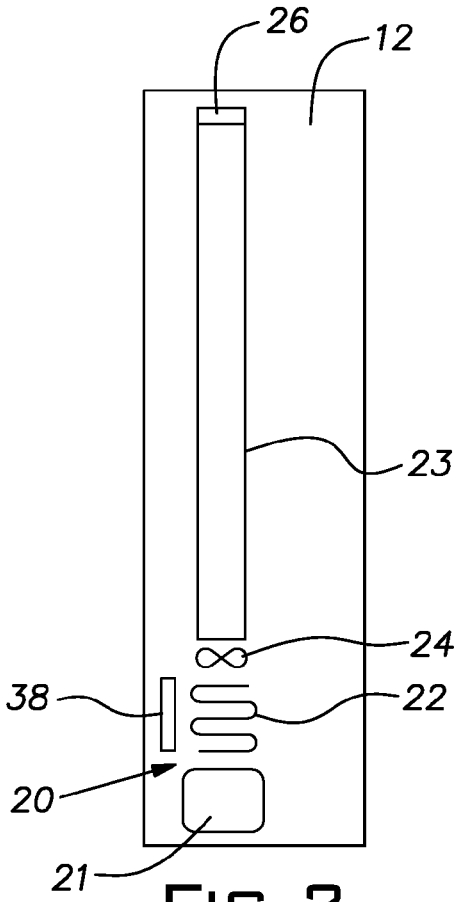
FIG. 2 is a schematic cross-sectional view along the line of 2-2 of FIG. 1.

It is also the case with refrigeration appliances that are currently available that more than one of the operating components of the appliances can influence the same operating feature of the refrigeration appliances. For example, with respect to a side-by-side refrigerator, as is known to those having ordinary skill in the art, the frequency at which recycling of the compressor of the refrigerator's cooling system occurs and the positioning of the damper that controls the flow of cold air from the freezer compartment to the fresh food compartment can both influence the air temperatures in the fresh food compartment and the freezer compartment of the refrigerator. In some instances even more than two of the refrigeration appliance's operating components can influence a particular operating feature at the refrigeration appliance. It is in such instances especially, even if the user is provided with all the means necessary for manipulating the operation of all the operating components influencing a particular operating feature at the refrigeration appliance, that the user typically does not have a sufficient understanding of the precise impact of each operating component on that operating feature to manipulate the operation of the operating components in a manner so as to optimally control that operating feature and optimize the performance of the refrigeration appliance with respect to one or more operating objectives. The present invention addresses this shortcoming FIG. 2 of the drawings comprises a schematic view of the refrigeration appliance 10 through the line 2-2 of FIG. 1 and illustrates certain operating components that can be included in the refrigeration appliance and can influence one or more operating features of the refrigerator. Certain of these operating components are also shown in FIG. 1 along with certain other elements of the refrigeration appliance.

A cooling system for the refrigeration appliance 10, indicated generally at 20, is shown as being located at the bottom and rear of the freezer compartment 12. Typically, the cooling system can include a compressor 21, a condenser, not shown, a metering device such as capillary tube, also not shown, an evaporator 22 and an evaporator fan 24. Air drawn by the evaporator fan 24 over the evaporator 22 is cooled and the cooled air can pass upwardly through the conduit 23 to the cold air opening 26 through which the cold air enters the freezer compartment 12 at the rear and near the top of the freezer compartment.

The cold air entering the freezer compartment 12 through cold air opening 26 can then move downwardly through the freezer compartment 12 to maintain the items stored in the freezer compartment in a frozen condition. An ice-maker 28, as best seen in FIG. 1, is located near the top of the freezer compartment 12, and a portion of the cold air that passes through the cold air opening 26 impinges on the ice-maker causing ice to be formed at the ice-maker.

Also as best seen in FIG. 1, cold air from the freezer compartment 12 passes through opening 30 in the wall 32 that separates the freezer compartment 12 from the fresh food compartment 14. A damper 34 located in the damper opening 30 can be modulated so as to control the quantity of cold air that can flow through the damper opening from the freezer compartment 12 to the fresh food compartment 14 as is familiar to those having ordinary skill in the art. Upon entering the fresh food compartment 14 through damper opening 30, the cold air moves downwardly through the fresh food compartment cooling the contents of the fresh food compartment. As the cold air performs its cooling function, its temperature increases and this warmer air reenters the cooling system 20 through the return opening 36 from where the returned air is once again drawn across the evaporator 22 by the evaporator fan 24. As is known to those having ordinary skill in the art, the returned air that is drawn across the evaporator by the evaporator fan can contain water moisture that will be extracted from the returning air to form frost or ice at the evaporator 22, thereby compromising the efficiency of the evaporator. To deal with the frost and/or ice, a heater 38 located adjacent the evaporator 22 is intermittently energized for the purpose of melting the frost and/or ice.

For the purpose of maintaining items stored in the fresh food compartment 14 at a temperature different from the temperature maintained generally in the fresh food compartment, a temperature-controlled drawer 40 can be located in the fresh food compartment as shown in FIG. 1. Cold air from the freezer compartment 12 can be supplied directly to the temperature-controlled drawer through an opening 44 in the wall 32 separating the freezer compartment and the fresh food compartment. The temperature-controlled drawer 40 also can include a heater for warming air circulated through the drawer by a fan and one or more dampers for controlling both the cold and warm air flows. A temperature-controlled drawer of this type is disclosed in U.S. patent application Ser. No. 11/759,311, filed on Jun. 26, 2007 and entitled Temperature Controlled Compartment, which disclosure is incorporated herein by reference. A temperature-controlled drawer that can be incorporated into the fresh food compartment of a bottom-mount household refrigerator is disclosed in U.S. patent application Ser. No. 12/394,189, filed on Feb. 27, 2009 and entitled Controlled Temperature Compartment for Refrigerator, which disclosure also is incorporated herein by reference. It is noted here that the temperature-controlled drawer in the bottom-mount refrigerator includes air passageways that provide for the flow of air into and out of the temperature-controlled drawer and that dampers are located in those passageways for controlling the air flow. As disclosed in U.S. application Ser. No. 12/394,189, the dampers can only be positioned so as to either fully open or fully close the passageways in which they are located.

A freezer compartment lighting element 46 and a fresh food compartment lighting element 48 are provided in the freezer compartment 12 and the fresh food compartment 14 respectively, for illuminating the interiors of those compartments. The electrical system provided for that purpose typically can be arranged so that each lighting element is energized only when the door of the compartment in which the lighting element is located is open.

As will now be described in greater detail, according to selected examples of the invention, one or more of the operating components that are referred to above as being included in the refrigeration appliance 10, as well as other operating components referred to below, are configured to operate in accordance with operating commands directed to the one or more operating components and to implement at the refrigeration appliance a mode of operation that is available for selective implementation by a user. In a particular aspect, the refrigeration appliance includes two or more operating components that are configured to operate in accordance with operating commands that are directed to the two or more operating components and to implement at the refrigeration appliance a mode of operation that is available for selective implementation by a user.

The implementation of modes of operation at the refrigeration appliance is accomplished in part in one example of the invention by means of a respective actuating device corresponding to each mode of operation that is available for selective implementation by the user at the refrigeration appliance upon the activation by the user of the respective actuating device. And in a particular embodiment, the refrigeration appliance can include two or more respective actuating devices, each actuating device corresponding to a respective mode of operation that is available for selective implementation by the user at the refrigeration appliance. Thus, as best seen in the embodiment of the invention illustrated in FIG. 3, several actuating devices indicated generally at 56 can be located at the front of the freezer compartment door 16 of the refrigeration appliance 10. These actuating devices allow a user to select a mode of operation that the user wishes to implement at the refrigeration appliance. More particularly, in the example of the invention shown in FIG. 3, the first actuating device 50, labeled "Energy," represents a mode of operation that maintains the consumption of energy at the refrigeration appliance 10 at reduced levels and can be considered to comprise an "Energy Optimized" mode of operation; the second actuating device 52, labeled "Temperature," represents a mode of operation that controls the variations in the temperatures present in the refrigeration appliance to which the items stored in the refrigeration appliance are subject so as to provide for a stable temperature profile and can be considered to comprise a "Temperature Optimized" mode of operation; and the third actuating device 54, labeled "Noise," represents a mode of operation that maintains the noise generated at the refrigeration appliance at reduced levels and can be considered to comprise a "Noise Optimized" mode of operation. The actuating devices 56 can comprise sites at a user interface such as a touch-screen display and the actuating devices can be selectively activated by the user touching the one of the touch-screen display sites that represents the operating mode that the user wishes to implement. However, the user interface need not comprise a touch-screen display and can comprise, for example, an interface that allows for selective implementation of an operating mode through the use of verbal commands directed at the user interface or by means of inputs delivered to the user interface over the internet.

Figure 3:
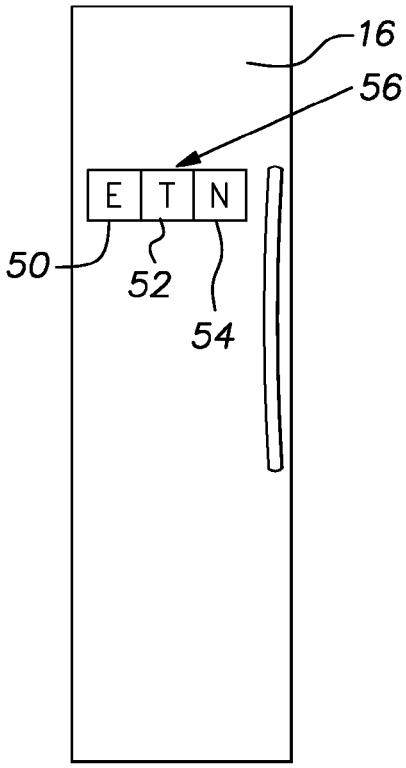
FIG. 3 is a schematic front elevational view of the door that closes off the freezer compartment of the refrigeration appliance of FIG. 1 and on which are mounted actuating devices associated with certain operating modes that can be implemented at the refrigeration appliance.

Although the embodiment of FIG. 3 includes the three modes of operation for the refrigeration appliance that relate broadly to the control of energy usage, temperature variation and noise generation, all three modes of operation need not be made available for selective implementation and only one or two of the three modes of operation need be made available. Indeed, none of these three modes of operation need be made available and other modes of operation can be made available instead. For example, a mode of operation that emphasizes the rapid generation of ice at the ice-maker 28 can be made available. And one or more of such other modes of operation can be made available together with one or more modes of operation that deal with the control of energy usage, temperature variation and noise generation, In any event, according to one aspect of the invention, at least one respective actuating device corresponding to a respective one of the three modes of operation relating to energy usage, temperature variations and noise generation is made available for selective implementation by the user at the refrigeration appliance. In addition, according to another aspect of the invention, the refrigeration appliance can include at least two respective actuating devices that correspond to a respective one of the modes of operation that are available for selective implementation by the user at the refrigeration appliance and concern energy usage, temperature variations and noise generation. For example, respective actuating devices can be provided corresponding to a mode of operation that concerns energy usage and a mode of operation that concerns temperature variations, or to a mode of operation that concerns temperature variations and a mode of operation that concerns noise generation or to a mode of operation that concerns energy usage and a mode of operation that concerns noise generation.

Figure 4:
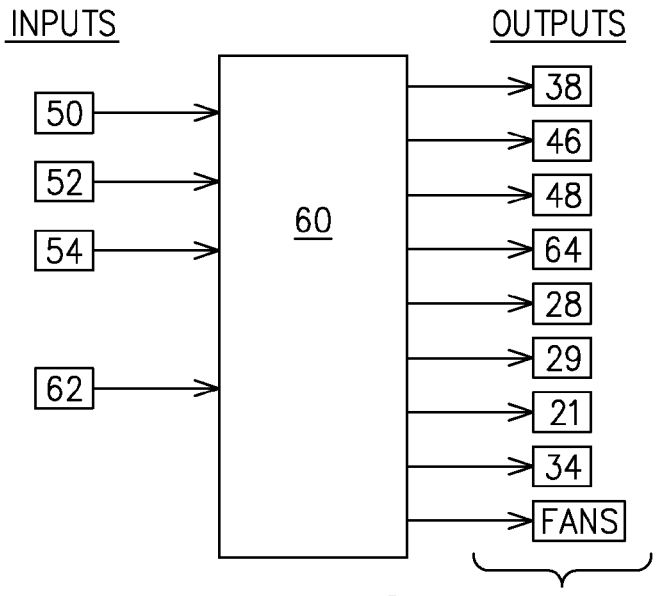
FIG. 4 is a diagram that illustrates aspects of certain operational components of the refrigeration appliance of FIG. 1 and their relationships with a controller and certain actuating devices.

In the example of the invention illustrated in FIG. 4, the implementation of a particular mode of operation is carried out in part by a controller 60 which can comprise a microprocessor. In the embodiment of FIG. 4, the controller 60 is shown to be operably associated with one or more operating components, indicated generally at 58, and each actuating device 56, provided at the refrigeration appliance 10. The controller 60 is configured to direct operating commands to the one or more operating components in response to the activation by the user of a respective actuating device. The direction of the operating commands to the one or more operating components causes the one or more operating components to which operating commands are directed to operate in a manner so as to selectively implement at the refrigeration appliance the mode of operation corresponding to the respective actuating device activated by the user. In the embodiment of FIG. 4, the controller 60 is shown as configured to receive electrical inputs resulting from the activation of the first actuating device 50, the second actuating device 52, the third actuating device 54 and various condition-sensing devices discussed below, such as a sensor 62 that senses the presence of ice and frost at the evaporator, and to generate electrical outputs in the form of operating commands to one or more operating components 58.

Mode of Operation Related to Energy Consumption

In one example of the invention, the refrigeration appliance includes one of at least two respective actuating devices that corresponds to am Energy Optimized mode of operation that maintains the consumption of energy at the refrigeration appliance 10 at reduced levels and is activated by the selection by the user of the first actuating device 50. And two or more operating components to which operating commands are directed by the controller to implement the Energy Optimized mode of operation that maintains the consumption of energy at the refrigeration appliance at reduced levels include two or more of at least five operating components.

The at least five operating components can include: apparatus configured to defrost the refrigeration appliance on demand; a damper system located in an air passageway leading from a freezer compartment to a temperature-controlled drawer located in a fresh food compartment of a bottom-mount refrigerator; apparatus configured to modify the level of illumination provided by lighting elements located at the refrigeration appliance; a compressor that is part of the system for producing cold air at the refrigeration appliance; and an apparatus for making ice. More specifically, in the case of the apparatus configured to defrost the refrigeration appliance on demand, the apparatus can include a heater, such as heater 38. Rather than being activated at preset times for example, which can represent a default status for the heater, the controller 60 can be programmed so as to activate the heater only when sufficient frost or ice are formed at the evaporator 22 to interfere with the efficient operation of the evaporator. As an example, the sensor 62 can be located at the evaporator for sensing the build-up of frost and ice at the evaporator and the sensed condition electrically input to the controller 60 as indicated in FIG. 4. Suitable sensors are familiar to those having ordinary skill in the art and can include, for example, laser sensors, sonar sensors and thermal sensors.

With respect to the damper system located in an air passageway leading from a freezer compartment to a temperature-controlled drawer located in a fresh food compartment of a bottom-mount refrigerator such as the dampers that are included with the temperature-controlled drawer described in U.S. patent application Ser. No. 12/394,189, rather than the dampers having only a fully open or fully closed position, they can be arranged so as to be capable of being modulated between those two positions as directed by commands from the controller 60 to a damper control device 64 that controls the positioning of the dampers. Modulation of the dampers prevents wide temperature swings from occurring. The wide temperature swings can result in undue energy consumption.

With respect to the apparatus configured to modify the level of illumination provided by lighting elements located at the refrigeration appliance, the electrical system for the freezer compartment lighting element, such as freezer compartment lighting element 46, and the fresh food compartment lighting element, such as fresh food compartment lighting element 48, can include a feature that allows the lighting elements to function at lower energy levels and the controller 60 can be programmed so as to activate that feature and thereby reduce the energy levels directed to the lighting elements. For example, those skilled in the art are familiar with such a feature wherein the lighting elements are turned on and off sufficiently rapidly that the action is not perceived by the user.

With respect to the apparatus for making ice, such as the ice-maker 28, energy usage can be reduced by reducing the quantity of ice made at the ice-maker for example. This can be accomplished in one aspect by the use of an air deflection device such as deflector 29 that can be located at the ice-maker. The air deflection device can be motorized so that the position of the deflector can be adjusted to deflect away from the ice-maker 28 the cold air issuing from the conduit 23 through cold air opening 26 whenever the first actuating device 50 is activated and the controller 60 in response to the electrical input from the first actuating device activates the motor controlling the position of the deflecting device. Activation of the motor adjusts the deflecting device from a position allowing the cold air exiting cold air opening 26 to impinge on the ice-maker to a position deflecting the cold air away from the ice-maker. The quantity of ice made at the ice-maker also can be reduced by the controller 60 directing operating commands to the ice-maker that cause the delivery of refill water to the ice-maker to be delayed each time after ice has been dispensed from the ice-maker. Energy usage also can be reduced by delaying most any step of the ice-making process including the harvesting of the ice.

With respect to the role that the compressor that is part of the system for producing cold air at the refrigeration appliance, such as the compressor 21, can play in maintaining the consumption of energy at reduced levels, it is first noted that the less time the compressor operates, the less energy is consumed. And the running time of the compressor can be reduced by minimizing the frequent stopping and starting of compressor operation that can accompany the opening and closing of the doors of the refrigeration appliance. The frequent stopping and starting of the compressor 21 related to door openings and closings can be dealt with and a more measured operation of the compressor can be accomplished by first performing a statistical analysis of the frequency and times of day at which the interior of the refrigeration appliance is exposed to the ambient environment. This analysis can then be programmed into the controller 60 so that the controller can direct operating commands to at least the compressor taking into account a statistical analysis of the frequency and times of day at which the interior of the refrigeration appliance is exposed to the ambient environment tending to cause the temperature of the interior of the refrigeration appliance to increase.

While the foregoing describes in detail five examples of the operating components to which operating commands can be directed by the controller 60 to implement an Energy Optimized mode of operation concerning the consumption of energy, operating components that can be controlled for the purpose of reducing energy consumption are not limited to those five operating components. Other operating components that also can be controlled for the purpose of controlling energy consumption can be employed.

Mode of Operation Related to Temperature Levels

In another example of the invention, the refrigeration appliance can include one of at least two respective actuating devices that corresponds to a Temperature Optimized mode of operation that controls the variations in the temperatures present in the refrigeration appliance to which items stored in the refrigeration appliance are subject so as to provide for a stable temperature profile and is activated by the selection by the user of the second actuating device 52. And two or more operating components to which operating commands can be directed by the controller 60 to implement the Temperature Optimized mode of operation that controls the variations in the temperatures present in the refrigeration appliance to which items stored in the refrigeration appliance are subject so as to provide for a stable temperature profile can include two or more of at least three operating components.

The at least three operating components can include: a damper located in a passageway of the refrigeration appliance for controlling the circulation of cold air in the passageway from a freezer compartment of the refrigeration appliance to a fresh food compartment of the refrigeration appliance; fans for circulating air in the refrigeration appliance, including an evaporator fan that is a part of a system for producing cold air at the refrigeration appliance; and a compressor that is part of the system for producing cold air at the refrigeration appliance. More specifically, the damper located in a passageway of the refrigeration appliance for controlling the circulation of cold air in the passageway from a freezer compartment of the refrigeration appliance to a fresh food compartment of the refrigeration appliance can comprise a damper such as the damper 34 located in the cold air opening 26 of the refrigeration appliance 10 for example. By providing for the controller 60, upon activation of the second actuating device 52, to direct appropriate operating commands to the control mechanism for the damper 34, the damper can be caused to remain in a fixed position rather than modulate and vary the size of the cold air opening 26. When the damper is maintained in a fixed position, the quantity of cold air flowing from the freezer compartment to the fresh food compartment will tend to be constant. As a result, the temperatures in the freezer compartment and the fresh food compartment will tend to remain at relatively constant levels and provide a stable temperature profile. A complementary way in which the damper 34 can be controlled by the controller 60 to assist in maintaining the temperatures at optimum levels is by having the damper maintained in a position completely opening cold air opening 26 when the compressor 21 is not operating. In that case, the warmer air in the fresh food compartment will have a tendency to flow upwardly in the fresh food compartment, i.e., reverse airflow will take place, and the airflow will continue even if the compressor and the associated evaporator fan is not operating. The continued air flow will reduce the likelihood that temperature gradients will be established in the refrigeration appliance.

With respect to the compressor that is a part of the system for providing cold air at the refrigeration appliance, such as compressor 21, the compressor can have operating commands directed to it by the controller 60 in at least two contexts to contribute to the implementation of the mode of operation that controls the variations in the temperatures present in the refrigeration appliance to which items stored in the refrigeration appliance are subject so as to provide for a stable temperature profile. First, the controller 60 can be programmed so as to activate the compressor 21 promptly each time a door of the refrigeration appliance is closed after having been opened, in the event the compressor is not running at that time, rather than waiting for the temperature of the refrigeration appliance to rise, as it typically does, after the interior of the refrigerator appliance has been exposed to the warmer ambient environment and the door has been subsequently closed. As a result, the temperatures in the refrigeration appliance will tend to be maintained at optimum levels. Second, a statistical analysis of the frequency and times of day at which the interior of the refrigeration appliance is exposed to the ambient environment can be made. This analysis can then be programmed into the controller 60 so that the controller can direct operating commands to at least the compressor 21 taking into account the statistical analysis of the frequency and times of day at which the interior of the refrigeration appliance is exposed to the ambient environment. Thus, for example, rather than allowing the temperatures of the refrigeration appliance to increase after door-opening events, the door-opening events can be anticipated and the controller 60 can cause the compressor to be activated based on those anticipated door-opening events. As a consequence, the variations in the temperatures present in the refrigeration appliance to which items stored in the refrigeration appliance are subject can be minimized so as to provide for a stable temperature profile.

With respect to the fans that are present in the refrigeration appliance for circulating air in the refrigeration appliance, including the evaporator fan 24, the controller 60 can be programmed so as to keep these fans running essentially continually so as to provide for better circulation of the air in the refrigeration appliance which will assist in the maintenance of optimum temperatures in the compartments of the refrigeration appliance.

While the foregoing describes in detail three examples of the operating components to which operating commands can be directed by the controller 60 to implement a Temperature Optimized mode of operation concerning temperature control, operating components that can be controlled for the purpose of temperature control are not limited to those three operating components. Other operating components that also can be controlled for the purpose of temperature control can be employed.

Mode of Operation Related to Noise Levels

In yet another example of the invention, the refrigeration appliance can include one of at least two respective actuating devices that corresponds to a Noise Optimized mode of operation that maintains the noise generated at the refrigeration appliance at reduced levels and is activated by the selection by the user of the third actuating device 56. And two or more operating components to which operating commands can be directed by the controller 60 to implement the Noise Optimized mode of operation that maintains the noise generated at the refrigeration appliance at reduced levels can include two or more of at least four operating components.

The at least four operating components can include: fans for circulating air in the refrigeration appliance, including an evaporator fan that is a part of a system for producing cold air at the refrigeration appliance; a compressor that is part of the system for producing cold air at the refrigeration appliance; apparatus for making ice; and apparatus configured to defrost the refrigeration appliance on demand including a heater whose heating action can be pulsed. More specifically, the fans can comprise variable speed fans and the controller 60 can be programmed to cause the fans, including the evaporator fan, to run at slower and, therefore, less noisy speeds when the third actuating device 56 has been activated. Similarly with respect to the compressor, such as compressor 21, it can be configured to operate at different speeds and the controller can be programmed to cause the compressor to run at slower and, therefore, less noisy speeds when the third actuating device 56 has been activated.

With respect to the apparatus for making ice, the controller 60 can be programmed to control the ice-maker, such as ice-maker 28, so as to cause the ice-maker to not make ice or make less ice, when the third actuating device 56 has been activated, thereby reducing the noise associated with the ice-making process.

With respect to the apparatus configured to defrost the refrigerator appliance such as the heater 38, the electric circuitry associated with the heater can include a feature that continually turns the heater off and on in a pulsating manner. And the controller can be programmed to activate this feature causing the heater to operate in a pulsed fashion. Operation of the heater in this fashion reduces the amount of heat energy that is input to the refrigeration appliance, thereby reducing the degree to which the compressor and fans must operate subsequently to recover from the heat energy input and reducing the noise associated with the compressor and fan operations.

In connection with all of the at least four of the operating components that can be involved in reducing the noise generated at the refrigeration appliance, a determination can be made of the times of day during which it is preferred that noise generated at the refrigeration appliance be maintained at reduced levels. And the controller 60 can be programmed so as to cause the noise generated by the noise-generating components of the refrigeration appliance to be maintained at reduced levels during those times of day. Of course, the controller 60 would also be programmed so as to not allow the operating components of the refrigeration appliance to operate in such a way as to jeopardize the ability of the refrigeration appliance to safely store the food items in the refrigeration appliance while maintaining the noise levels at a reduced level.

While the foregoing describes in detail four examples of the operating components to which operating commands can be directed by the controller 60 to implement a Noise Optimized mode of operation concerning noise generation, operating components that can be controlled for the purpose of noise control are not limited to those four operating components. Other operating components that also can be controlled for the purpose of controlling the generation of noise can be employed.

In a further example of the invention, the refrigeration appliance can include one of at least two or more respective actuating devices that corresponds to an Energy Optimized mode of operation that maintains the consumption of energy at the refrigeration appliance at reduced levels and another one of the at least two or more respective actuating devices that corresponds to a Temperature Optimized mode of operation that controls the variations in the temperatures present in the refrigeration appliance to which items stored in the refrigeration appliance are subject so as to provide for a stable temperature profile. And in this further example, the two or more operating components associated with these two modes of operation can include a respective two or more of at least seven operating components comprising at least: apparatus configured to defrost the refrigeration appliance on demand; a damper system located in an air passageway leading from a freezer compartment to a temperature-controlled drawer located in a fresh food compartment of a bottom-mount refrigerator; apparatus configured to modify the level of illumination provided by lighting elements located at the refrigeration appliance; a compressor that is part of the system for producing cold air at the refrigeration appliance; an apparatus for making ice at the refrigeration appliance; a damper located in a passageway of the refrigeration appliance for controlling the circulation of cold air in the passageway from a freezer compartment of the refrigeration appliance to a fresh food compartment of the refrigeration appliance; and an evaporator fan that is a part of a system for producing cold air at the refrigeration appliance.

In yet another example of the invention, the refrigeration appliance can include, in addition to the respective actuating devices that corresponds to an Energy Optimized mode of operation that maintains the consumption of energy at the refrigeration appliance at reduced levels and a respective actuating device that corresponds to a Temperature Optimized mode of operation that controls the variations in the temperatures present in the refrigeration appliance to which items stored in the refrigeration appliance are subject so as to provide for a stable temperature profile, an actuating device that corresponds to a Noise Optimized mode of operation that maintains the noise generated at the refrigeration appliance at reduced levels. And in this further example, the two or more operating components relating to the Noise Optimized mode of operation can include two or more of at least four operating components comprising at least: one or more fans at the refrigeration appliance; a compressor that is part of the system for producing cold air at the refrigeration appliance; an apparatus for making ice at the refrigeration appliance; and apparatus configured to defrost the refrigerator appliance on demand including a heater whose heating action can be pulsed.

Typically, the operating components of refrigerator appliances can be preset by the manufacturer to operate in a prescribed manner. For example, in a household refrigerator, the operating parameters of the operating components that influence the temperatures to be routinely maintained in the freezer and fresh food compartments can be preset so that those operating components will function to establish the temperatures that are to be routinely maintained. These temperatures can represent default temperatures to which the refrigeration appliance will return should an event such as a power failure occur. In this connection, an aspect of the present invention can be applied to a refrigeration appliance wherein at least one of the one or more operating components that is initially preset to operate in a prescribed manner, such as in a default state for example, and the controller is configured, in response to the activation by the user of a respective actuating device, to direct operating commands to the at least one of the one or more operating components that is initially preset and modify the presetting of the at least one of the one or more operating components that is initially preset. In another aspect two or more operating components can be initially preset and the presetting modified by commands directed to the two or more operating components by the controller.

In certain instances, the user may not wish to have the refrigeration appliance function in modes of operation as described above. Rather, the preference of the user can be to have the refrigeration appliance operate such the preset or default operating conditions of the operating components are implemented. For that purpose, the refrigeration appliance can include a respective actuating device corresponding to a mode of operation that represents the preset operating conditions. And the controller 60 can be programmed so as to implement those preset conditions at the operating components upon the activation of the respective actuating device corresponding to a mode of operation that represents the preset operating conditions.

The invention in certain aspects also concerns methods of operating a refrigeration appliance that can include one or more operating components that are configured to operate in accordance with operating commands directed to the one or more operating components and implement at the refrigeration appliance a mode of operation that is available for selective implementation by a user. In these methods, the refrigeration appliance would include a respective actuating device corresponding to each mode of operation that is available for selective implementation by the user at the refrigeration appliance upon the activation by the user of the respective actuating device. The methods would include activating a respective actuating device that corresponds to a mode of operation selected for implementation and directing operating commands to the one or more operating components in response to the activation of the respective actuating device, causing the one or more operating components to which operating commands are directed to operate in a manner so as to selectively implement at the refrigeration appliance the mode of operation selected for implementation. In connection with these other aspects of the invention concerning methods of operating a refrigeration appliance, the methods can be applied in connection with the various aspects of the invention described previously.

While the present invention has been described above and illustrated with reference to certain aspects, examples and embodiments thereof, it is to be understood that the invention is not so limited. Modifications and variations of these aspects, examples and embodiments will occur to those skilled in the art upon reading and understanding the specification, including the drawings. The present invention is intended to cover and include any and all such modifications and variations that are encompassed by the following claims.

What is claimed is:

1. A refrigeration appliance including:

a plurality of operating components that are configured to operate in accordance with operating commands directed to the plurality of operating components and implement at the refrigeration appliance modes of operation that are available for selective implementation by a user;

a respective actuating device corresponding to each mode of operation that is available for selective implementation by the user at the refrigeration appliance upon the activation by the user of the respective actuating device; and a controller operably associated with the plurality of operating components and each respective actuating device, the controller being configured to direct operating commands to one or more of the operating components in response to the activation by the user of a respective actuating device, causing the one or more of the operating components to which operating commands are directed to operate in a manner so as to selectively implement at the refrigeration appliance the mode of operation corresponding to the respective actuating device activated by the user, wherein the modes of operation include a mode of operation that maintains the consumption of energy at the refrigeration appliance at reduced levels, a mode of operation that controls the variations in the temperatures present in the refrigeration appliance to which items stored in the refrigeration appliance are subject so as to provide for a stable temperature profile, and a mode of operation that maintains noise generated at the refrigeration appliance at reduced levels, and wherein, in both of the mode of operation that maintains the consumption of energy at the refrigeration appliance at reduced levels and the mode of operation that controls the variations in the temperatures present in the refrigeration appliance to which items stored in the refrigeration appliance are subject so as to provide for a stable temperature profile, the controller is configured to activate a compressor of the refrigeration appliance to cool the interior of the refrigeration appliance based on a statistical analysis of the frequency and times of day at which the interior of the refrigeration appliance is exposed to the ambient environment, wherein, in both of the mode of operation that maintains the consumption of energy at the refrigeration appliance at reduced levels and the mode of operation that controls the variations in the temperatures present in the refrigeration appliance to which items stored in the refrigeration appliance are subject so as to provide for a stable temperature profile, the controller determines when to activate the compressor from a result of the statistical analysis, wherein, in the mode of operation that controls the variations in the temperatures present in the refrigeration appliance to which items stored in the refrigeration appliance are subject so as to provide for a stable temperature profile, the controller is further configured to activate the compressor each time a door of the refrigeration appliance is opened and then subsequently closed when the compressor is not running, wherein the controller is configured to operate an ice-maker of the refrigeration appliance to produce ice at a reduced rate while continuing to produce ice if the refrigeration appliance is in either one of the mode of operation that maintains the consumption of energy at the refrigeration appliance at reduced levels and the mode of operation that maintains noise generated at the refrigeration appliance at reduced levels, and wherein the compressor is a variable speed compressor and the refrigeration appliance includes variable speed fans, and when the mode of operation that maintains the noise generated at the refrigeration appliance at reduced levels is selected, operating speeds of the variable speed compressor and variable speed fans while running are reduced due to said selection, to thereby reduce noise generated by the variable speed compressor and fans.

2. The refrigeration appliance of claim 1 wherein at least one of the plurality of operating components is initially preset to operate in a prescribed manner and the controller is configured, in response to the activation by the user of a respective actuating device, to direct operating commands to the at least one of the plurality of operating components that is initially preset and modify the presetting of the at least one of the plurality of operating components that is initially preset.

3. The refrigeration appliance of claim 1 wherein the refrigeration appliance includes an adjustable air deflector adjacent to the ice-maker, wherein in the mode of operation that maintains the consumption of energy at the refrigeration appliance at reduced levels, the adjustable air deflector is positioned to deflect cold air away from the ice-maker, and wherein in another mode of operation, the adjustable air deflector is positioned to allow cold air to impinge on the ice-maker.

4. The refrigeration appliance of claim 1 wherein one actuating device corresponds to the mode of operation that maintains the consumption of energy at the refrigeration appliance at reduced levels and operating components that are configured to operate in accordance with operating commands directed from the controller to implement the mode of operation that maintains the consumption of energy at the refrigeration appliance at reduced levels include two or more of: apparatus configured to defrost the refrigeration appliance on demand; a damper system located in an air passageway leading from a freezer compartment to a temperature-controlled drawer located in a fresh food compartment of a bottom-mount refrigerator; apparatus configured to modify the level of illumination provided by lighting elements located at the refrigeration appliance; the compressor; and the ice-maker.

5. The refrigeration appliance of claim 1 wherein one actuating device corresponds to the mode of operation that controls the variations in the temperatures present in the refrigeration appliance to which items stored in the refrigeration appliance are subject so as to provide for a stable temperature profile and operating components that are configured to operate in accordance with operating commands directed from the controller to implement the mode of operation that maintains the temperatures present in the refrigeration appliance at levels that optimize the preservation of food items stored in the refrigeration appliance include two or more: a damper located in a passageway of the refrigeration appliance for controlling the circulation of cold air in the passageway from a freezer compartment of the refrigeration appliance to a fresh food compartment of the refrigeration appliance; an evaporator fan that is a part of a system for producing cold air at the refrigeration appliance; and the compressor.

6. The refrigeration appliance of claim 1 wherein one actuating device corresponds to the mode of operation that maintains the noise generated at the refrigeration appliance at reduced levels and, in the mode of operation that maintains the noise generated at the refrigeration appliance at reduced levels, a defrost heater of the refrigeration appliance is pulsed on and off.

7. The refrigeration appliance of claim 1 wherein one actuating device corresponds to the mode of operation that maintains the consumption of energy at the refrigeration appliance at reduced levels and another of the actuating devices corresponds to the mode of operation that controls the variations in the temperatures present in the refrigeration appliance to which items stored in the refrigeration appliance are subject so as to provide for a stable temperature profile, and operating components that are configured to operate in accordance with operating commands directed from the controller to implement the mode of operation that maintains the consumption of energy at the refrigeration appliance at reduced levels and the mode of operation that controls the variations in the temperatures present in the refrigeration appliance to which items stored in the refrigeration appliance are subject so as to provide for a stable temperature profile include a respective two or more of: apparatus configured to defrost the refrigeration appliance on demand; a damper system located in an air passageway leading from a freezer compartment to a temperature-controlled drawer located in a fresh food compartment of a bottom-mount refrigerator; apparatus configured to modify the level of illumination provided by lighting elements located at the refrigeration appliance; the compressor; the ice-maker; a damper located in a passageway of the refrigeration appliance for controlling the circulation of cold air in the passageway from a freezer compartment of the refrigeration appliance to a fresh food compartment of the refrigeration appliance; and an evaporator fan that is a part of a system for producing cold air at the refrigeration appliance.

8. A method of operating a refrigeration appliance that includes plurality of operating components that are configured to operate in accordance with operating commands directed to the plurality of operating components and implement at the refrigeration appliance modes of operation that are available for selective implementation by a user, and a respective actuating device corresponding to each mode of operation that is available for selective implementation by the user at the refrigeration appliance upon the activation by the user of the respective actuating device, the method including:

activating a respective actuating device that corresponds to a mode of operation selected for implementation; and directing operating commands to one or more of the operating components in response to the activation of the respective actuating device, causing the one or more of the operating components to which operating commands are directed to operate in a manner so as to selectively implement at the refrigeration appliance the mode of operation corresponding to the respective actuating device activated by the user, wherein the modes of operation include a mode of operation that maintains the consumption of energy at the refrigeration appliance at reduced levels, a mode of operation that controls the variations in the temperatures present in the refrigeration appliance to which items stored in the refrigeration appliance are subject so as to provide for a stable temperature profile, and a mode of operation that maintains noise generated at the refrigeration appliance at reduced levels, wherein, in both of the mode of operation that maintains the consumption of energy at the refrigeration appliance at reduced levels and the mode of operation that controls the variations in the temperatures present in the refrigeration appliance to which items stored in the refrigeration appliance are subject so as to provide for a stable temperature profile, a controller in the refrigeration appliance is configured to activate a compressor of the refrigeration appliance to cool the interior of the refrigeration appliance based on a statistical analysis of the frequency and times of day at which the interior of the refrigeration appliance is exposed to the ambient environment, wherein, in both of the mode of operation that maintains the consumption of energy at the refrigeration appliance at reduced levels and the mode of operation that controls the variations in the temperatures present in the refrigeration appliance to which items stored in the refrigeration appliance are subject so as to provide for a stable temperature profile, the controller determines when to activate the compressor from a result of the statistical analysis, wherein, in the mode of operation that controls the variations in the temperatures present in the refrigeration appliance to which items stored in the refrigeration appliance are subject so as to provide for a stable temperature profile, the controller is further configured to activate the compressor each time a door of the refrigeration appliance is opened and then subsequently closed when the compressor is not running, wherein the controller is configured to operate an ice-maker of the refrigeration appliance to produce ice at a reduced rate while continuing to produce ice if the refrigeration appliance is in either one of the mode of operation that maintains the consumption of energy at the refrigeration appliance at reduced levels and the mode of operation that maintains noise generated at the refrigeration appliance at reduced levels, and wherein the compressor is a variable speed compressor and the refrigeration appliance includes variable speed fans, and when the mode of operation that maintains the noise generated at the refrigeration appliance at reduced levels is selected, operating speeds of the variable speed compressor and variable speed fans while running are reduced due to said selection, to thereby reduce noise generated by the variable speed compressor and fans.

9. The method of claim 8 wherein at least one of the plurality of operating components is initially preset to operate in a prescribed manner and the operating commands are directed to the at least one of the plurality of operating components that is initially preset to modify the presetting of the at least one of the plurality of operating components that is initially preset.

10. The method of claim 8 wherein the refrigeration appliance includes an adjustable air deflector adjacent to the ice-maker, wherein in the mode of operation that maintains the consumption of energy at the refrigeration appliance at reduced levels, the adjustable air deflector is positioned to deflect cold air away from the ice-maker, and wherein in another mode of operation, the adjustable air deflector is positioned to allow cold air to impinge on the ice-maker.

11. The method of claim 8 wherein operating components to which operating commands are directed to implement the mode of operation that maintains the consumption of energy at the refrigeration appliance at reduced levels include two or more of: apparatus configured to defrost the refrigeration appliance on demand; a damper system located in an air passageway leading from a freezer compartment to a temperature-controlled drawer located in a fresh food compartment of a bottom-mount refrigerator; apparatus configured to modify the level of illumination provided by lighting elements located at the refrigeration appliance; the compressor; and the ice-maker.

12. The method of claim 8 wherein operating components to which operating commands are directed to implement the mode of operation that controls the variations in the temperatures present in the refrigeration appliance to which items stored in the refrigeration appliance are subject so as to provide for a stable temperature profile include two or more of: a damper located in a passageway of the refrigeration appliance for controlling the circulation of cold air in the passageway from a freezer compartment of the refrigeration appliance to a fresh food compartment of the refrigeration appliance; an evaporator fan that is part of the system for producing cold air at the refrigeration appliance; and the compressor.

13. The method of claim 8 wherein operating components to which operating commands are directed to implement the mode of operation that maintains the noise generated at the refrigeration appliance at reduced levels include a defrost heater that is pulsed on and off in the mode of operation that maintains the noise generated at the refrigeration appliance at reduced levels.

14. The refrigeration appliance of claim 8 wherein the operating components include: apparatus configured to defrost the refrigeration appliance on demand; a damper system located in an air passageway leading from a freezer compartment to a temperature-controlled drawer located in a fresh food compartment of a bottom-mount refrigerator; apparatus configured to modify the level of illumination provided by lighting elements located at the refrigeration appliance; the compressor; the ice-maker; a damper located in a passageway of the refrigeration appliance for controlling the circulation of cold air in the passageway from a freezer compartment of the refrigeration appliance to a fresh food compartment of the refrigeration appliance; and an evaporator fan that is a part of a system for producing cold air at the refrigeration appliance.

* * * * *